US009850704B2

(12) United States Patent
Jang

(10) Patent No.: US 9,850,704 B2
(45) Date of Patent: Dec. 26, 2017

(54) UNDER STRUCTURE OF BLIND APPARATUS AND BLIND APPARATUS HAVING THE SAME

(71) Applicant: Wintec Korea Inc., Gwangju-si, Gyeonggi-do (KR)

(72) Inventor: Seong Ryong Jang, Seoul (KR)

(73) Assignee: Wintec Korea Inc., Gyeonggi-do (KR)

( * ) Notice: Subject to any disclaimer, the term of this patent is extended or adjusted under 35 U.S.C. 154(b) by 0 days.

(21) Appl. No.: 15/226,145

(22) Filed: Aug. 2, 2016

(65) Prior Publication Data

US 2017/0292323 A1 Oct. 12, 2017

(30) Foreign Application Priority Data

Apr. 12, 2016 (KR) ..... 10-2016-0045159

(51) Int. Cl.

| | |
|---|---|
| ***E06B 9/56*** | (2006.01) |
| ***E06B 9/66*** | (2006.01) |
| ***E06B 9/17*** | (2006.01) |
| *E06B 9/24* | (2006.01) |

(52) U.S. Cl.

CPC ..... *E06B 9/56* (2013.01); *E06B 9/17046* (2013.01); *E06B 9/66* (2013.01); *E06B 2009/2447* (2013.01)

(58) Field of Classification Search

CPC ..... E06B 9/56; E06B 9/44; E06B 9/78; E06B 9/66; E06B 9/17046; E06B 2009/2447; E06B 2009/2405

See application file for complete search history.

(56) References Cited

U.S. PATENT DOCUMENTS 2,519,638 A * 8/1950 Di Marzo Vincent .... E06B 9/66 160/272
4,393,915 A * 7/1983 Olson ..... E06B 9/17046 160/384
5,412,225 A * 5/1995 Dutta ..... B82Y 20/00 257/18

(Continued)

FOREIGN PATENT DOCUMENTS

CA 2915204 A1 * 12/2014
DE 202016100428 * 2/2016

(Continued)

OTHER PUBLICATIONS

Canadian Patent Application dated May 5, 2017 for corresponding CA Application No. 2,936,596.

*Primary Examiner* — Blair M Johnson
(74) *Attorney, Agent, or Firm* — Harness, Dickey & Pierce, P.L.C.

(57) ABSTRACT

The present invention provides an under-structure of a blind apparatus.

An under-structure of a blind apparatus according to an embodiment of the present invention includes: a first bar that holds the lower end of a screen; a plug that is coupled to an end of the first bar and has a first through-hole at the center; a second bar that receives the first bar and has a slit through which the screen comes out; a cover that is fixed to an end of the second bar and has a second through-hole communicating with the first through-hole; and a wrench plug that is coupled to the outside of the cover and is fitted in the first through-hole through the second through-hole to transmit torque.

10 Claims, 10 Drawing Sheets

(56) References Cited

U.S. PATENT DOCUMENTS

| | | | | |
|---|---|---|---|---|
| 7,931,069 | B2 * | 4/2011 | Cannaverde | E06B 9/322 160/170 |
| 8,499,814 | B2 * | 8/2013 | Ng | E06B 9/324 160/168.1 R |
| 2005/0028943 | A1 * | 2/2005 | Chang | E06B 9/42 160/23.1 |
| 2012/0043029 | A1 * | 2/2012 | Gaskill | E06B 9/42 160/121.1 |
| 2015/0322715 | A1 * | 11/2015 | Chou | E06B 9/78 160/321 |
| 2017/0009519 | A1 * | 1/2017 | Marocco | E06B 9/44 |

FOREIGN PATENT DOCUMENTS

| | | | |
|---|---|---|---|
| KR | 101357736 | B1 | 2/2014 |
| KR | 101357737 | B1 | 2/2014 |

* cited by examiner (a)

(b)

(a)

(b)

UNDER STRUCTURE OF BLIND APPARATUS AND BLIND APPARATUS HAVING THE SAME

CROSS-REFERENCE TO RELATED APPLICATION

This application claims priority to and the benefit of Korean Patent Application No. 10-2016-0045159, filed on Apr. 12, 2016, the disclosure of which is incorporated herein by reference in its entirety.

BACKGROUND OF THE INVENTION

Field of the Invention

The present invention relates to an under-structure of a blind apparatus and a blind apparatus having the same and, more particularly, to an under-structure of a blind apparatus that can adjust the length of a screen, and a blind apparatus having the under-structure of a blind apparatus.

Description of the Related Art

In general, a blind apparatus is installed in space with windows or window walls such as a dining room, a room, and an office to shut out light, hinder vision, or adjust the amount of light traveling inside. In most blind apparatuses, an end of a screen is fixed to a roll at the top and the other end is fixed to a roll bar at the bottom so the blind is pulled up or down over a window or a window wall by rolling or unrolling the screen on or from the roll bar, in which the screen is a single screen or a double screen composed of separate screens.

The double screen can adjust the amount of light only when fully unrolled. Accordingly, when the entire length of a window is shorter than the length of a screen fully unrolled, it is required to fully unroll the screen to adjust the amount of light and then roll back up the screen to fit to the entire length of the window.

Therefore, there is a need for a blind apparatus that can adjust the entire length of a screen to fit to the entire length of a window.

CITATION LIST

Patent Literature

Patent Literature 1: Korean Patent No. 10-1357736 (2014, Jan., 24.)

SUMMARY OF THE INVENTION

An object of the present invention is to provide an under-structure of a blind apparatus that can adjust the length of a screen.

Another object of the present invention is to provide a blind apparatus that can adjust the length of a screen.

The objects of the present invention are not limited to those described above and other objects not stated herein may be clearly understood by those skilled in the art from the following description.

In order to achieve the objects of the present invention, an embodiment of the present invention provides an under-structure of a blind apparatus that includes: a first bar that holds the lower end of a screen; a plug that is coupled to an end of the first bar and has a first through-hole at the center;

a second bar that receives the first bar and has a slit through which the screen comes out; a cover that is fixed to an end of the second bar and has a second through-hole communicating with the first through-hole; and a wrench plug that is coupled to the outside of the cover and is fitted in the first through-hole through the second through-hole to transmit torque.

The wrench bar may have a non-circular cross-sectional portion in at least a predetermined section and the first through-hole may have a non-circular cross-section the same as the cross-section of the wrench bar.

The wrench bar may have a prismatic first section and a cylindrical second section extending from the first section.

The wrench bar may have at least one projections protruding outward at the boundary between the first section and the second section.

The wrench bar may apply elasticity to the inner side of the first through-hole by being longitudinally divided into several parts.

The outer diameter at an end of the wrench bar may be larger than the inner diameter of the first through-hole.

At least one fixing hole may be formed at any one of the wrench plug and the cover in the contact surface of the wrench plug and the cover and a fixing protrusion inserted in the fixing hole may be formed at the other one.

The wrench plug may include a flange part extending outward at the end of the wrench bar and an elastic member disposed between the flange part and the plug and transmits elasticity to bring the wrench plug in contact with the cover.

The under-structure may further include a handle that is coupled to the wrench plug and has a grip that is larger in diameter or thickness than the wrench plug.

Another embodiment of the present invention provides a blind apparatus including: a screen; a roll that is fixed to the upper end of the screen to roll up the screen; and the under-structure of a blind apparatus of any one of claims 1 to 9.

The screen may include: a first screen and a second screen attached to different positions on the outer side of the roll and overlapping each other; and a plurality of third screens connecting the first screen and the second screen to each other and arranged in parallel with regular intervals.

DETAILED DESCRIPTION OF THE PREFERRED EMBODIMENTS

Figure 1:
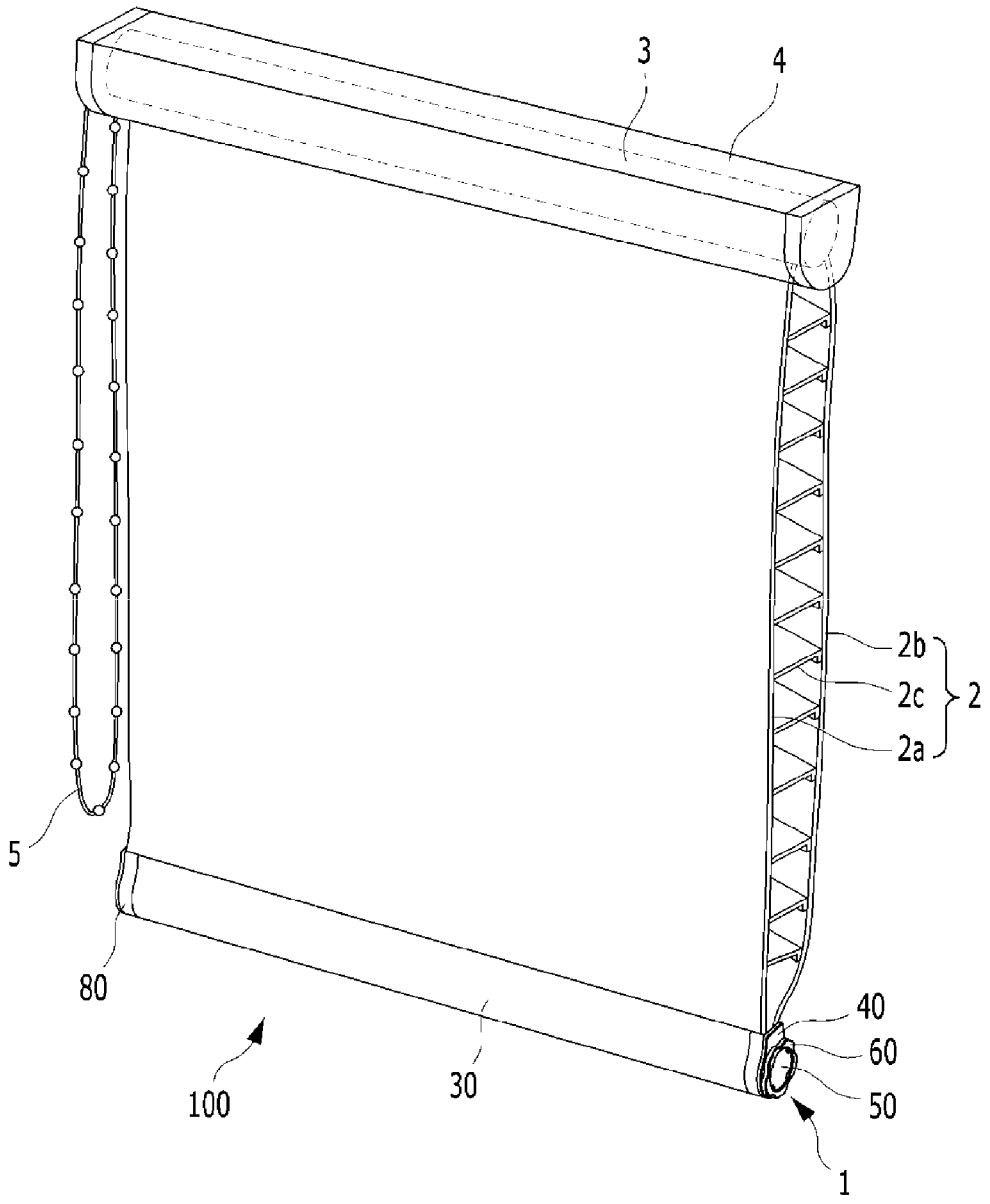
FIG. 1 is a perspective view showing a blind apparatus according to an embodiment of the present invention.

The advantages and features of the present invention, and methods of achieving them will be clear by referring to the exemplary embodiments that will be describe hereafter in detail with reference to the accompanying drawings. However, the present invention is not limited to the exemplary embodiments described hereafter and may be implemented in various ways, and the exemplary embodiments are provided to complete the description of the present invention and let those skilled in the art completely know the scope of the present invention and the present invention is defined by claims. Like reference numerals denote like elements throughout the descriptions.

An under-structure of a blind apparatus according to an exemplary embodiment of the present invention and a blind apparatus having the under-structure will be described hereafter in detail with reference to FIGS. 1 to 9.

A blind apparatus according to an embodiment of the present invention is an apparatus for hinders vision to block the inside from the outside and adjust an amount of light form the outside.

The under-structure of a blind apparatus and the blind apparatus having the under-structure can adjust the entire length of a fully unrolled screen in accordance with the entire length of a window through simple operation without assembling or disassembling. Adjusting the entire length of a fully unrolled screen means adjusting the longitudinal length of the entire screen fully unrolled down. Accordingly, when it is a double screen, it is possible to remove the trouble that it is required to fully unroll down a screen to adjust the amount of light and then roll back up the screen. Further, it is possible to easily remove wrinkles or waves at the lower end or around the lower end of the screen, so the external appearance of the blind apparatus can be improved, and functional deterioration of the blind apparatus due to wrinkles or waves can be prevented.

Hereinafter, an under-structure 1 of a blind apparatus and a blind apparatus 100 having the under-structure will be described in detail with reference to FIGS. 1 to 4.

Figure 2:
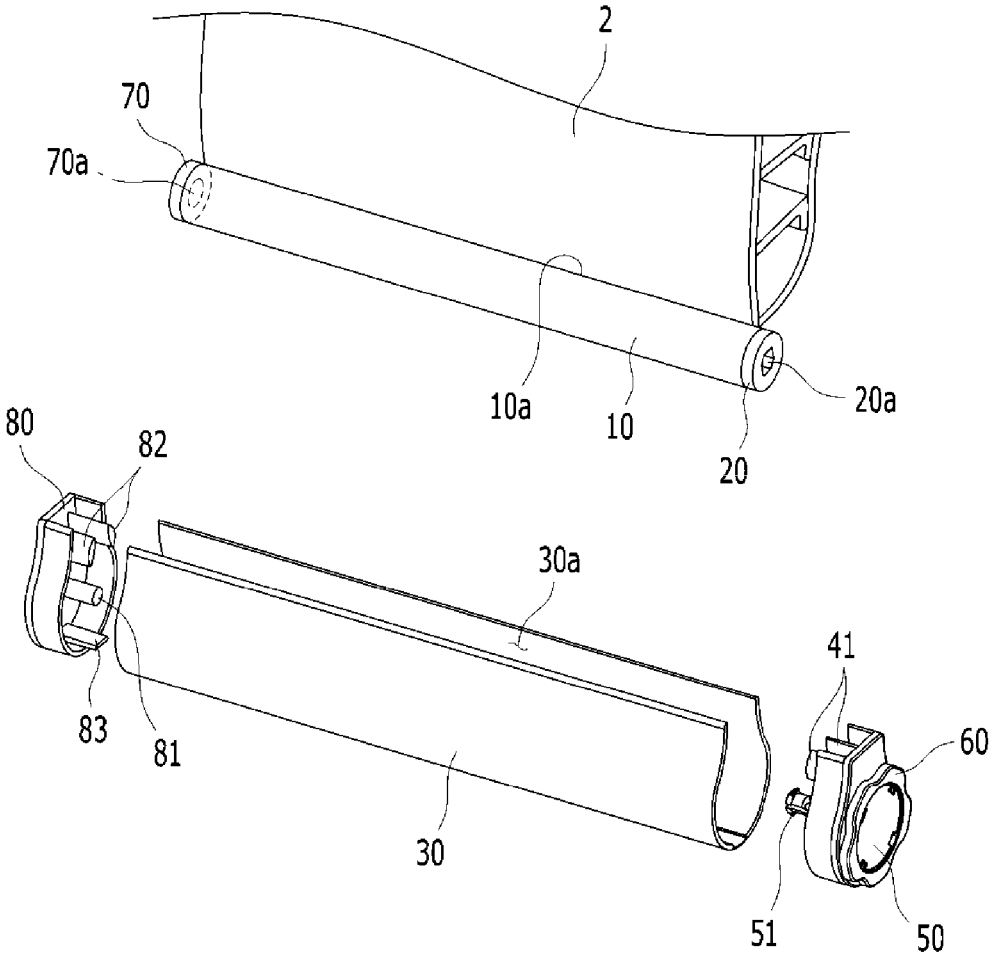
FIG. 2 is an exploded perspective view showing an under-structure of the blind apparatus shown in FIG. 1.
Figure 3:
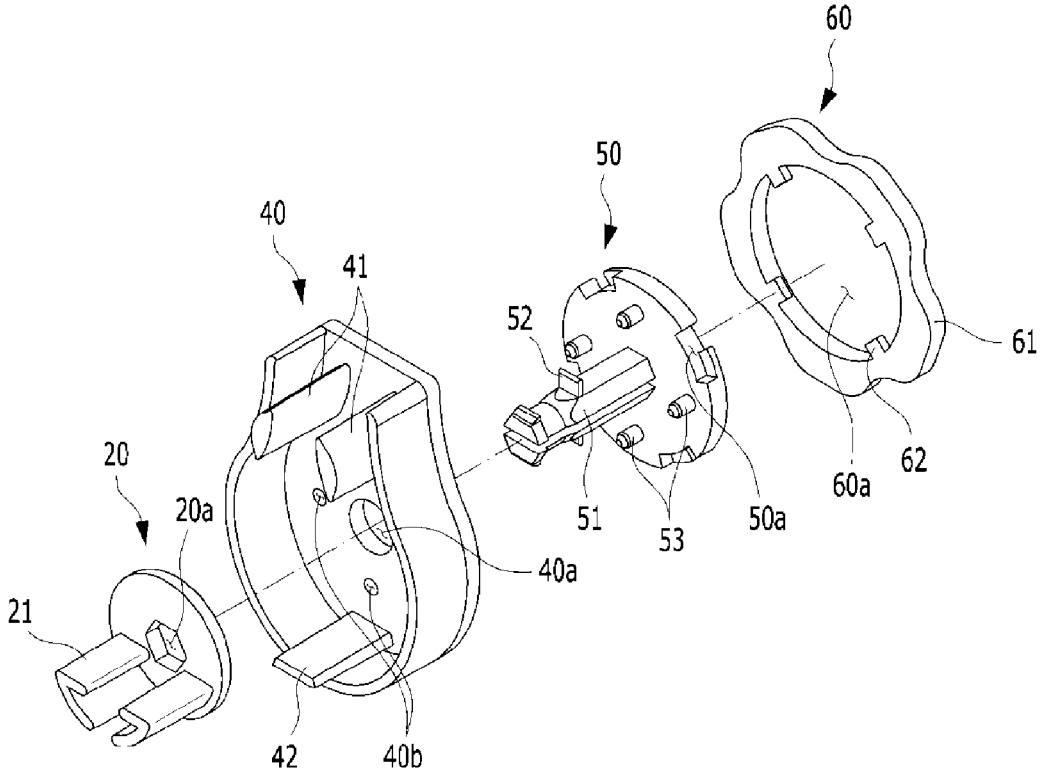
FIG. 3 is an exploded perspective view enlarging a portion of the under-structure of the blind apparatus.
Figure 4:
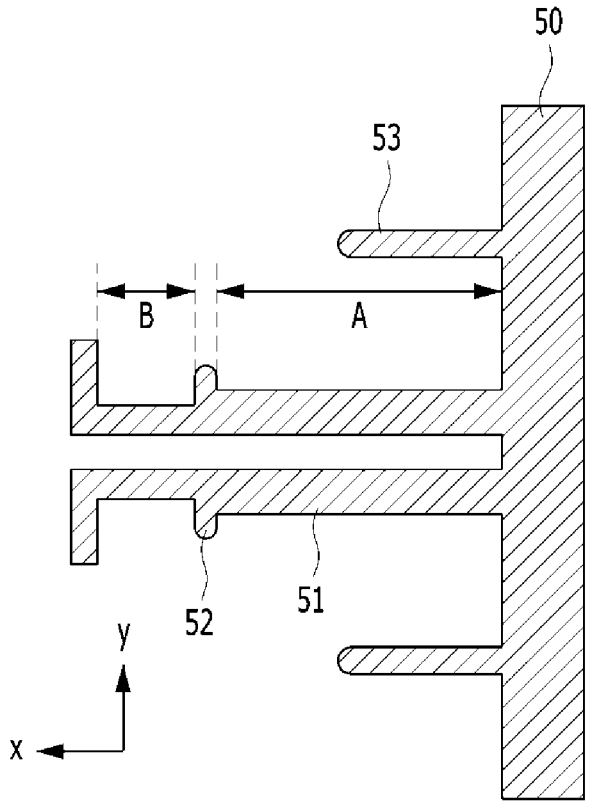
FIG. 4 is a cross-sectional view of a wrench plug.

FIG. 1 is a perspective view showing a blind apparatus according to an embodiment of the present invention, FIG. 2 is an exploded perspective view showing an under-structure of the blind apparatus shown in FIG. 1, FIG. 3 is an exploded perspective view enlarging a portion of the under-structure of the blind apparatus, and FIG. 4 is a cross-sectional view of a wrench plug.

The under-structure 1 of a blind apparatus according to the present invention, which is connected to the lower end of a screen 2 to unroll down and fix the entire screen 2 using its own weight, includes a first bar 10, a plug 20, a second bar 30, a cover 40, and a wrench plug 50.

The first bar 10, which is a cylindrical member, holds the lower end of the screen 2. The first bar 10, as shown in FIG. 2, has at least one insertion groove 10*a* formed in the longitudinal direction of the first bar 10 and recessed inside the first bar 10, so the lower end of the screen 2 can be inserted and fixed in the insertion groove 10*a*. A plurality of insertion grooves 10*a* may be formed around the outer circumference of the first bar 10 and the screen 2 may be selectively inserted into any one of the insertion grooves 10*a*. If necessary, it is possible to couple a plurality of screens 2 to the first bar 10 by inserting the screens 2 in different insertion grooves 10*a*. A plug 20 is coupled to a first end of the first bar 10.

The plug 20, a part rotating the first bar using torque from the wrench plug 50 to be described below, as shown in FIGS. 2 and 3, has a first through-hole 20*a*. The first through-hole 20*a* is formed at the center of the plug 20, so it is aligned with the rotational center axis of the first bar 10. The rotational center axis of the first bar 10 means a virtual axis that is arranged in the longitudinal direction of the first bar 10 and passes through the center of the first bar 10. Since the first through-hole 20*a* is aligned with the rotational center axis of the first bar 10, the first bar 10 can more stable rotate. That is, the first through-hole 20*a* is eccentrically positioned from the rotational center axis of the first bar 10, the first bar 10 may unstably rotate, so the first through-hole 20*a* is positioned on the rotational center axis of the first bar 10, that is, at the center of the plug 20 in order for the first bar 10 can smoothly rotate without eccentricity.

The plug 20 may be coupled to at least coupling portion 21 protruding toward the first bar 10, and when the plug 20 is separated from the first bar 10, the first end of the first bar 10 can be opened. Accordingly, with the first end of the first bar 10 open, the screen 2 can be more easily inserted into the insertion groove 10*a*. Although a pair of protruding coupling portions 21 is formed on the plug 20 in the figures, the present invention is not limited thereto and the number and shape of the coupling portion 21 may be variously changed.

The first bar 10 is inserted in disposed in the second bar 30.

The second bar 30 is a hollow cylinder that is larger in diameter of the first bar 10. Accordingly, the first bar 10 can be disposed in the empty space inside the second bar 30. The second bar 30 is not necessarily a cylinder and may be formed an elliptical space having a space inside for keeping the first bar 10, or may be formed in other polygonal bar shapes rather than a cylindrical or an elliptical shape. Further, when there is a sufficient space inside the second bar 30, the first bar 10 may also change in various shapes such as a polygonal bar shape other than the cylindrical shape as long as it can freely change.

The first bar 10 is fully inserted in the second bar 30 and the screen 2 comes out through a slit 30*a* formed through the outer side of the second bar 30. To this end, the first bar 10 may be smaller in entire length than the second bar 30. The slit 30*a* may be changed in length in accordance with the width of the screen 2 and may be appropriately changed in width in accordance with the thickness of the screen 2 or the number of screens 2 coupled to the first bar 10.

The cover 40 is fixed to a first end of the second bar 30.

The cover 40 may have a shape corresponding to the transversal cross-section of the second bar 30 and to cover the first end of the second bar 30 and to be open at the top to overlap the slit 30*a* of the second bar 30. Accordingly, even though the cover 40 is coupled, the screen 2 can freely enter the slit 30*a* through the top of the cover 40.

The cover 40 has a second through-hole 40*a* that communicates with the first through-hole 20*a*. The second through-hole 40*a* may be formed in a circular shape through the cover 40, as shown in the figures, but may be formed in shapes other than a circle, if necessary. That is, the shape of the second-through-hole 40*a* is not specifically limited as long as the second through-hole 40*a* has an appropriate width large enough for a wrench bar 51 of the wrench plug 50 to be described below can be easily inserted into the first through-hole 20*a*. The minimum diameter of the second through-hole 40*a* may be larger than the maximum diameter of the first through-hole 20*a* so that the wrench bar 51 can be easily inserted into the first through-hole 20*a* through the second through-hole 40*a* even if the second through-hole 40*a* is not a circle.

The cover 40 is coupled to the second bar 30 such that the edge protruding toward the second bar 30 in contact with the second bar 30, whereby it can be firmly coupled to the first end of the second bar 30. Further, the cover 40 can be more firmly combined with the second bar 30 by at least fastening protrusions 41 and 42 protruding to the inside of the second bar 30. A pair of first fastening protrusions 41 and a fastening protrusion 42 are formed at over and under the second through-hole 40*a*, respectively, in the figures, but the present invention is not limited thereto and the positions, numbers, and shapes of the first fastening protrusions 41 and the second fastening portion 42.

The wrench plug 50 is coupled to the outside of the cover 40.

The wrench plug 50, which is provided to apply torque to the plug 20 and the first bar 10, has the wrench bar 51 that is fitted in the first through-hole 20*a* through the second through-hole 40*a* to transmit torque. In other words, when the wrench plug 50 is coupled to the outside of the cover 40, the wrench bar 51 is fitted in the first through-hole 20*a* through the second through-hole 40*a* of the cover 40, so torque from the wrench plug 50 can be transmitted to the plug 20 and the first bar 10.

The wrench bar 51, as shown in FIG. 3, protrudes from the wrench plug 50 toward the first through-hole 20*a* and has a non-circular cross-sectional portion in at least some section. Accordingly, the first through-hole 20*a* where the wrench bar 51 is fitted may have a non-circular cross-section the same as that of the wrench bar 51. Since the cross-sections of the wrench bar 51 and the first through-hole 20*a* are not a circle, the wrench bar 51 can be firmly engaged in the first through-hole 20*a*. In other words, the wrench bar 51 having a non-circular cross-section is fitted in the first through-hole 20*a* having a non-circular cross-section with corners such as a polygon, so the corners are fitted to each other, thereby firmly combining them. Accordingly, the wrench bar 51 fitted in the first through-hole 20*a* is rotated, so the torque from the wrench plug 50 can be effectively transmitted to the plug 20 and the first bar 10. Although the first through-hole 20*a* has a hexagonal cross-section and the wrench bar 51 is formed in the shape of a hexagonal prism in the figures, the present invention is not limited thereto, and the shape of the first through-hole 20*a* and the cross-sectional shape of the wrench bar 51 may be formed in various non-circular shapes. For example, the shape of the first through-hole 20*a* and the cross-sectional shape of the wrench bar 51 may include not only rotation-symmetric shapes, but other various asymmetric shapes or nonfinite shapes that have a corner so be fitted to each other.

The wrench bar 51 may have a prismatic first section A and a cylindrical second section B extending from the first section A. Referring to FIGS. 3 and 4, in detail, the wrench bar 51 has the first section A formed in a prismatic shape at a portion connected to the wrench plug 50 and the second section B formed in a cylindrical shape at the other portion extending from the first section A. Since the wrench bar 51 has the prismatic first section A and the cylindrical second section B, it is possible to adjust rotation of the plug 20 and the first bar 10, depending on the sections of the wrench bar 51 inserted in the first through-hole 20*a*. For example, when the first section A of the wrench bar 51 is inserted in the first through-hole 20*a*, the wrench bar 51 is fitted in the first through-hole 20*a*, the plug 20 and the first bar 10 rotate in the same direction as the wrench plug 50, whereby the screen 2 can be rolled on or unrolled from the first bar 10. In contrast, when the second section B of the wrench bar 51 is inserted in the first through-hole 20*a*, the wrench bar 51 is not fitted in the first through-hole 20*a*, torque from the wrench plug 50 is not transmitted to the plug 20 and the first bar 10.

The wrench bar 51 may have at least one projection 52 protruding outward at the boundary between the first section A and the second section B. As at least one projection 52 that protrudes perpendicular to the longitudinal direction of the wrench bar 51 (to the X-direction in FIG. 4) at the boundary between the first section A and the second section B, a user can accurately recognize the first section A and the second section B even through the wrench plug 50 is coupled to the cover 40 and the plug 20, that is, the wrench bar 51 is fitted in the first through-hole 20*a*. Accordingly, it is possible to easily adjust the entire length of the screen 2 by turning the plug 20 and the first bar 10 even without separating the wrench plug 50 from the cover 40 and the plug 20.

Further, the wrench bar 51 can apply elasticity to the inner side of the first through-hole 20*a* by being longitudinally divided in several parts. The longitudinal direction means the longitudinal direction of wrench bar 51. As the wrench bar 51 is divided in several parts and applies elasticity to the inner side of the first through-hole 20*a*, the wrench bar 51 and the first through-hole can be more strongly fitted, so it is possible to easily turn the plug 20 and the first bar 10 even with small force.

The wrench bar 51 has an outer diameter at the end larger than the inner diameter of the first through-hole 20*a*, so it can prevent the wrench plug 50 from separating from the plug 20.

Fixing holes 40*b* may be formed at any one of the wrench plug 50 and the cover 40 and fixing protrusions 53 may be formed at the other one. It is assumed hereafter that the fixing holes 40*b* are formed at the cover 40 and the fixing protrusions 53 are formed at the wrench plug 50.

At least one fixing hole 40*b* is formed around the second through-hole 40*a* of the cover 40 through the side being in contact with the wrench plug 50. Although four fixing holes 40*b* are formed around the second through-hole 40*a*, the present invention is not limited thereto and the position, number, and shape of the fixing holes 40*b* may be changed in various ways. The fixing projections 53 are inserted in the fixing hole 40*b*. The fixing protrusions 53 protrude toward the cover 40 on the side being in contact with the cover 40 and are inserted in the fixing holes 40*b*, thereby fixing the wrench plug 50. At least one fixing protrusion 53 may be formed outside the wrench bar 51, corresponding to the position, number, and shape of the fixing hole 40*b*.

A handle 60 is coupled to the outside of the wrench plug 50.

The handle 60, which is provided to operate the wrench plug 50, has a third through-hole 60*a* at the center for inserting the wrench plug 50. The handle 60 has a grip 61 outside the third through-hole 60*a* and the grip 61 may be larger in diameter or thickness than the wrench plug 50. As described above, the wrench plug 50 is coupled to the outside of the cover 40. Accordingly, when the wrench plug 50 has a larger diameter or larger thickness, it can be easily operated by a user, but the wrench plug 50 protrudes too much out of the cover 40, so it is likely to be separated from the cover 40 and the external appearance of the blind apparatus 100 is deteriorated.

The under-structure 1 of a blind apparatus according to the present invention is characterized in that the wrench plug 50 has a small diameter and a small thickness and the separate handle 60 for operating the wrench plug 50 is provided in order to improve the external appearance of the blind apparatus 100 and enable a user to easily operate the apparatus. The handle 60 is separably coupled to the wrench plug 50. That is, the handle 60 is coupled to the wrench plug 50 to operate the wrench plug 50, but is separated from the wrench plug 50 and stowed after finishing the operation.

Fastening grooves 50*a* may be formed at any one of the handle 60 and the wrench plug 50 and fastening protrusions 62 may be formed at the other one. It is assumed that the fastening holes 50*a* are formed at the wrench plug 50 and the fastening protrusions 62 are formed at the handle 60.

At least one fastening groove 50*a* is formed on the outer circumferential surface of the wrench plug 50, that is, on the surface coming in contact with the handle 60. The fastening hole 50*a* is recessed on the wrench plug 50 and has a stepped structure, so it can prevent separation of the fastening protrusion 62. Although a four fastening grooves 50*a* are formed around the outer circumferential surface of the wrench plug 50 in the figures, the present invention is not limited thereto and the number and shape of fastening groves 50*a* may be variously changed. The fastening protrusions 62 are inserted into the fastening groove 50*a*. The fastening protrusions 62 are formed on the surface coming in contact with the wrench plug 50, that is, protrude toward the wrench plug 50 inside the third through-hole 60*a* and are inserted in the fastening grooves 50*a*, thereby fixing the wrench plug 50 and the cover 40. The fastening protrusion 62 may be formed to correspond to the position, number, and shape of the fastening grooves 50*a*.

An assistant plug 70 is coupled to a second end of the first bar 10.

The assistant plug 70, which is provided to cover the second end of the first bar 10, has a rotational hole 70*a* at the center. The rotational hole 70*a* is formed in a circular shape, unlike the first through-hole 20*a*, and can hold a rotary shaft 81 formed on the assistant cover 80 such that the rotary shaft 81 can rotate. The rotational hole 70*a* may also be formed on the rotational center axis of the first bar 10 and the first bar 10 can be more stably rotated by a pair of the rotational hole 70*a* and the first through-hole 20*a* on the rotational center axis of the first bar 10.

The assistant cover 80 is coupled to the second end of the second bar 30 where the cover 40 is not coupled, thereby closing the second end of the second bar 30. The rotary shaft 81 protruding toward an end of the first bar 10 may be formed at the center of the assistant cover 80 and may be rotatably inserted in the rotational hole 70*a* of the assistant plug 70 coupled to the end of the first bar 10. The rotary shaft 81 may be formed in the same shape as the rotational hole 70*a*. The assistant cover 80 is disposed at the opposite side to the cover 40 in a pair with the cover 40. The assistant cover 80 and the cover 40 may be the same when seen from the outside, but the rotary shaft 81 is formed inside the assistant cover 80, so the assistant cover 80 can support the first bar 10 with the rotary shaft 81 inserted in the rotational hole 70*a* so that the first bar 10 can stably rotate. That is, the rotary shaft 81, the rotational hole 70*a*, the first through-hole 20*a*, and the wrench bar 51 inserted in the first through-hole 20*a* are all positioned on the rotational center axis of the first bar 10 so that the first bar 10 can easily rotate while maintaining balance.

The edge of assistant cover 80 protruding toward the second bar 30, similar to the cover 40, is contact with the second bar 30, so it can be firmly coupled to the end of the second bar 30. Further, the assistant cover 80 can be more firmly combined with the second bar 30 by at least couplers 82 and 83 protruding to the inside of the second bar 30. A pair of first fastening protrusions 82 and a fastening protrusion 83 are formed at over and under the rotary shaft 81, respectively, in the figures, but the present invention is not limited thereto and the positions, numbers, and shapes of the first fastening protrusions 82 and the second fastening portion 83.

The blind apparatus 100 according to the present invention includes the screen 2, the roll 3, and the under-structure 1 of a blind apparatus.

The screen 2 includes a first screen 2*a* and a second screen 2*b* overlapping each other and a plurality of third screens 2*c* connecting the first screen 2*a* and the second screen 2*b* and arranged in parallel with regular intervals. Referring to FIGS. 1 and 2, the first screen 2*a* and the second screen 2*b* overlap each other and transmit light, but the third screens 2*c* are inserted between the first screen 2*a* and the second screen 2*b* and block light. In other words, the first screen 2*a* and the second screen 2*b* are nets that at least partially transmit light and the third screens 2*c* are blinds that block light. Accordingly, the screen 2 can transmit or block light in accordance with the overlapping types of the first screen 2*a*, the second screen 2*b*, and the third screens 2*c*.

For example, when the third screens are 2*c* are vertically arranged between the first screen 2*a* and the second screen 2*b*, light passing through any one of the first screen 2*a* and the second screen 2*b* is blocked by the third screens 2*c*, so it cannot pass through the last one. The third screens 2*c* are vertically arranged between the first screen 2*a* and the second screen 2*b*, but partially overlap each other, so they can block light. In contrast, when the third screens are 2*c* are horizontally arranged between the first screen 2*a* and the second screen 2*b*, light passing through any one of the first screen 2*a* and the second screen 2*b* can pass through the last one.

The upper end of the screen 2 is fixed to the roll 3. The roller 3, which fixes the upper end of the screen 2 and rolls up the screen 2, is a bar or a rod having a length corresponding to the width of the screen 2 and is rotatably disposed in a housing 4. The upper ends of the first screen 2*a* and the second screen 2*b* are connected longitudinally to both sides of the roll 3, respectively, in which the connected portions of the first screen 2*a* and the second screen 2*b* may extend in parallel in the same plane. In other words, the first screen 2*a* and the second screen 2*b* are tightly connected to different positions on the roll 3, respectively.

The roll 3 is rotated by a specific opening/closing unit, for example, a chain 5 to roll up the screen 2, in which the chain 5 may be coupled to the connected portions of the first screen 2*a* and the second screen 2*b*. Accordingly, when the roll 3 is rotated by pulling the chain, the first screen 2*a* is moved with respect to the second screen 2*b* and the third screens 2*c* are moved with the first screen 2*a*. The third screens 2*c* moving with the first screen 2*a*, as described above, may be vertically or horizontally positioned between the first screen 2*a* and the second screen 2*b*, whereby they can pass or block light.

For example, when the chain 5 coupled to the connected portion of the second screen 2*b* is pulled down, the roll 3 is rotated and the connected portion of the first screen 2*a* is moved up than the connected portion of the second screen 2*b*. Accordingly, as the first screen 2*a* moves up than the second screen 2*b*, the third screens 2*c* are moved with the first screen 2*a* and vertically arranged between the first screen 2*a* and the second screen 2*b*. When the third screens 2*c* are vertically arranged, light is blocked. With light blocked by the third screens 2*c*, when the chain 5 coupled to the connected portion of the first screen 2*a*, the roll 3 is rotated and the connected portion of the first screen 2*a* is moved into the same plane as the connected portion of the second screen 2*b*. Accordingly, the first screen 2*a* returns to the initial position and the third screens 2*c* are horizontally arranged between the first screen 2*a* and the second screen 2*b*. When the third screens 2*c* are horizontally arranged, light is passed.

Hereinafter, the operation of the under-structure 1 of a blind apparatus and a blind apparatus 100 having the under-structure will be described in more detail with reference to FIGS. 5 to 9.

Figure 5:
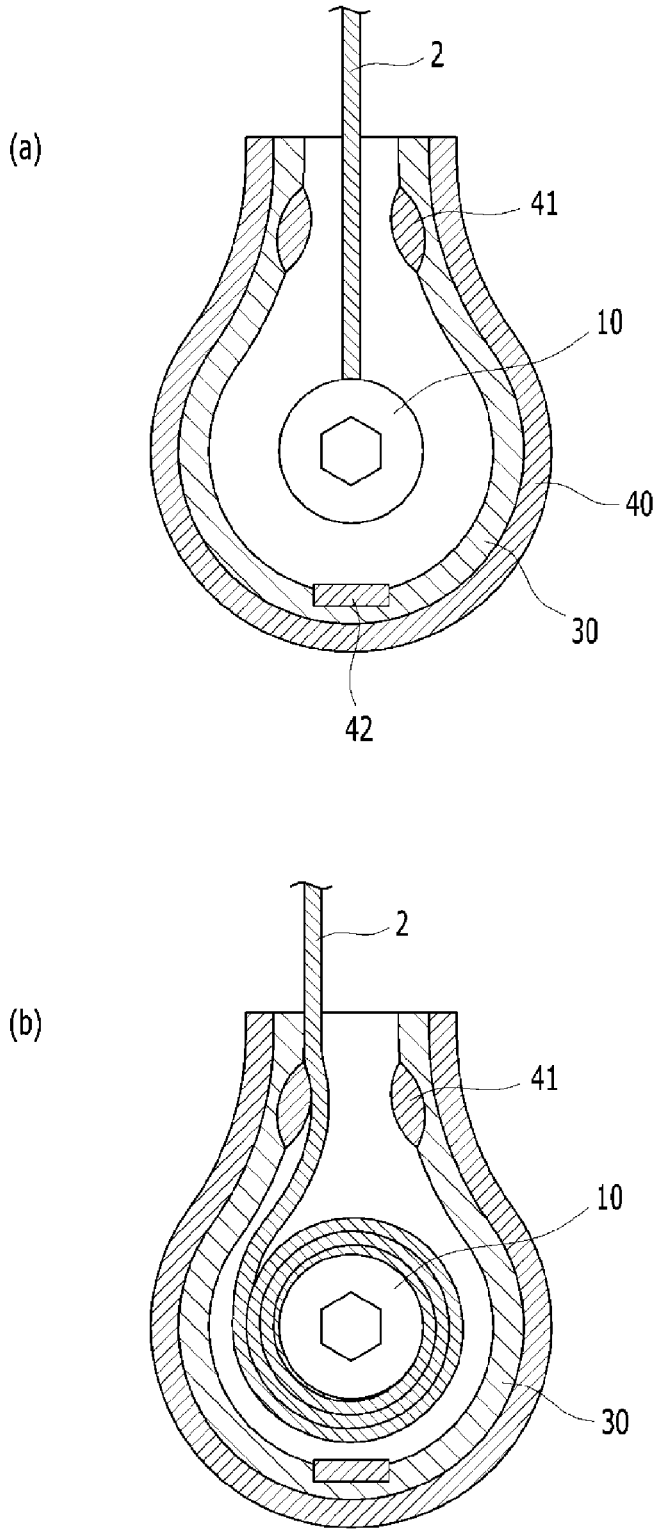
FIG. 5 is a view showing a change in length of a screen by rotation of a first bar.
Figure 6:
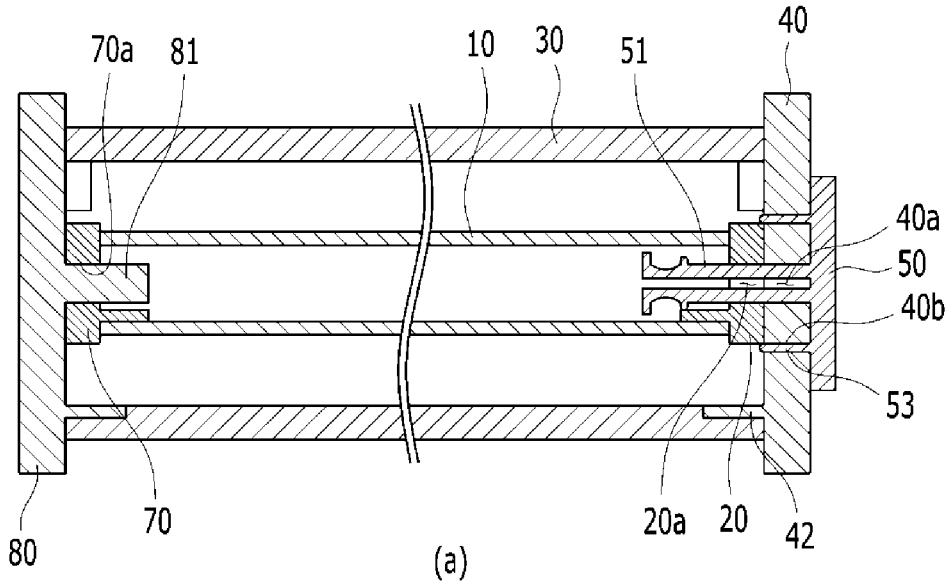
FIGS. 6 and 7 are view illustrating the operation of the under-structure.
Figure 6:
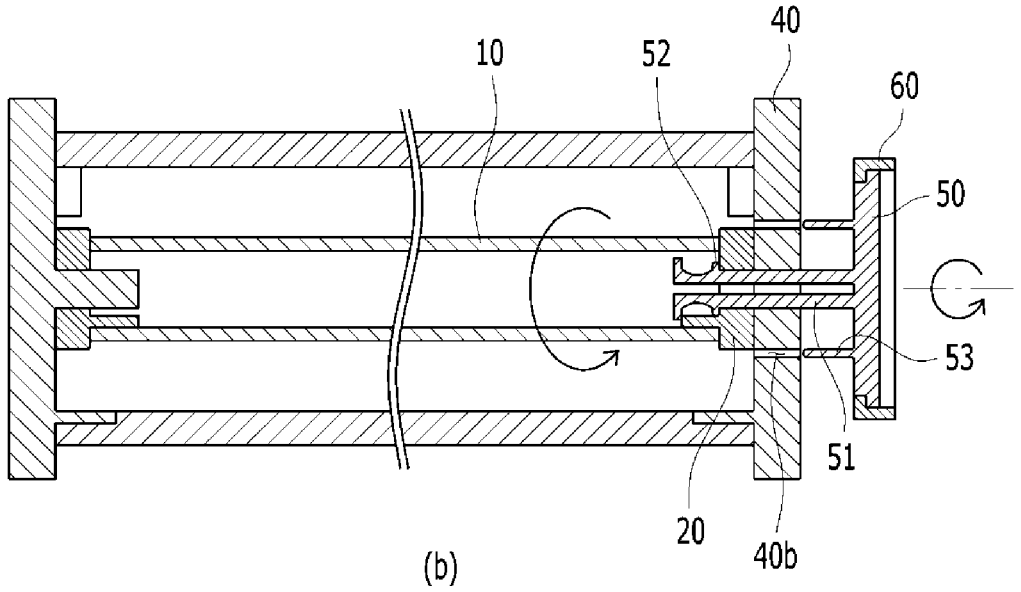
Figure 7:
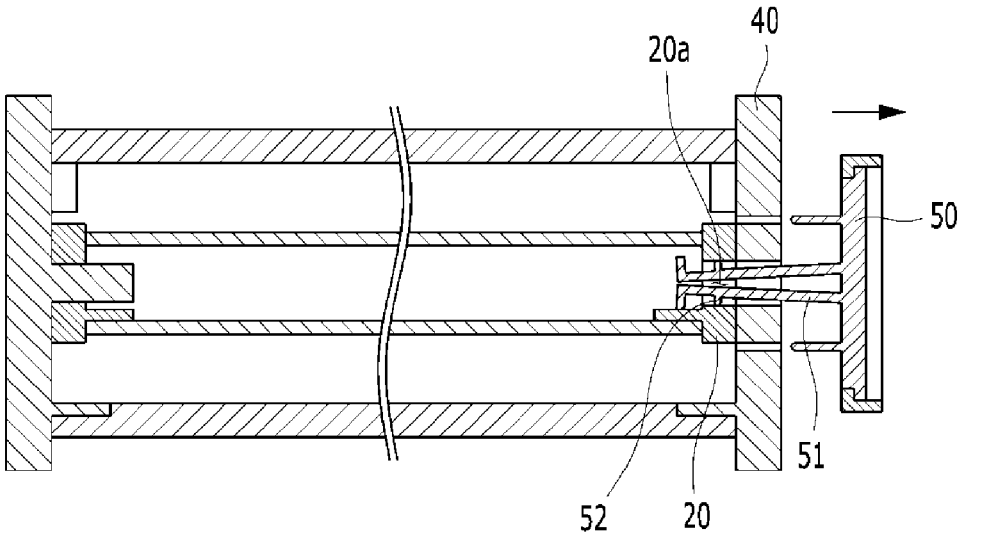
Figure 7:
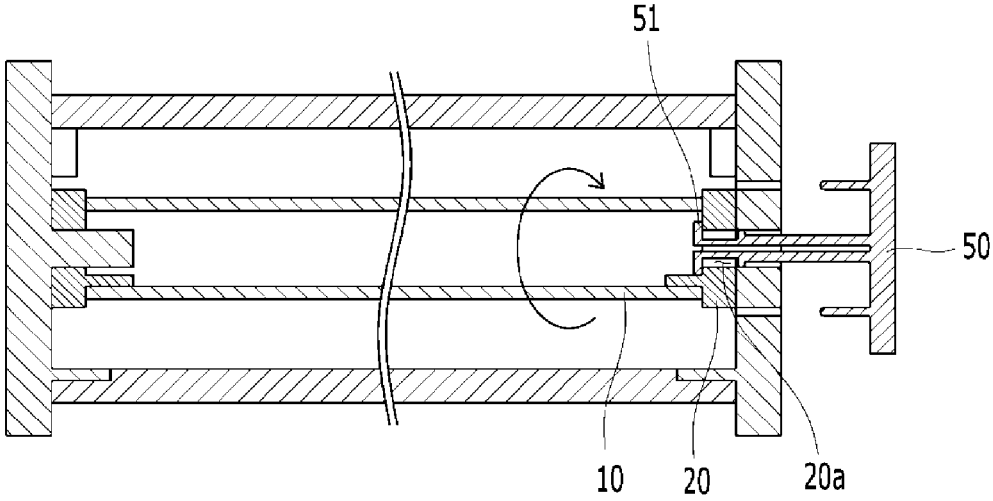
Figure 8:
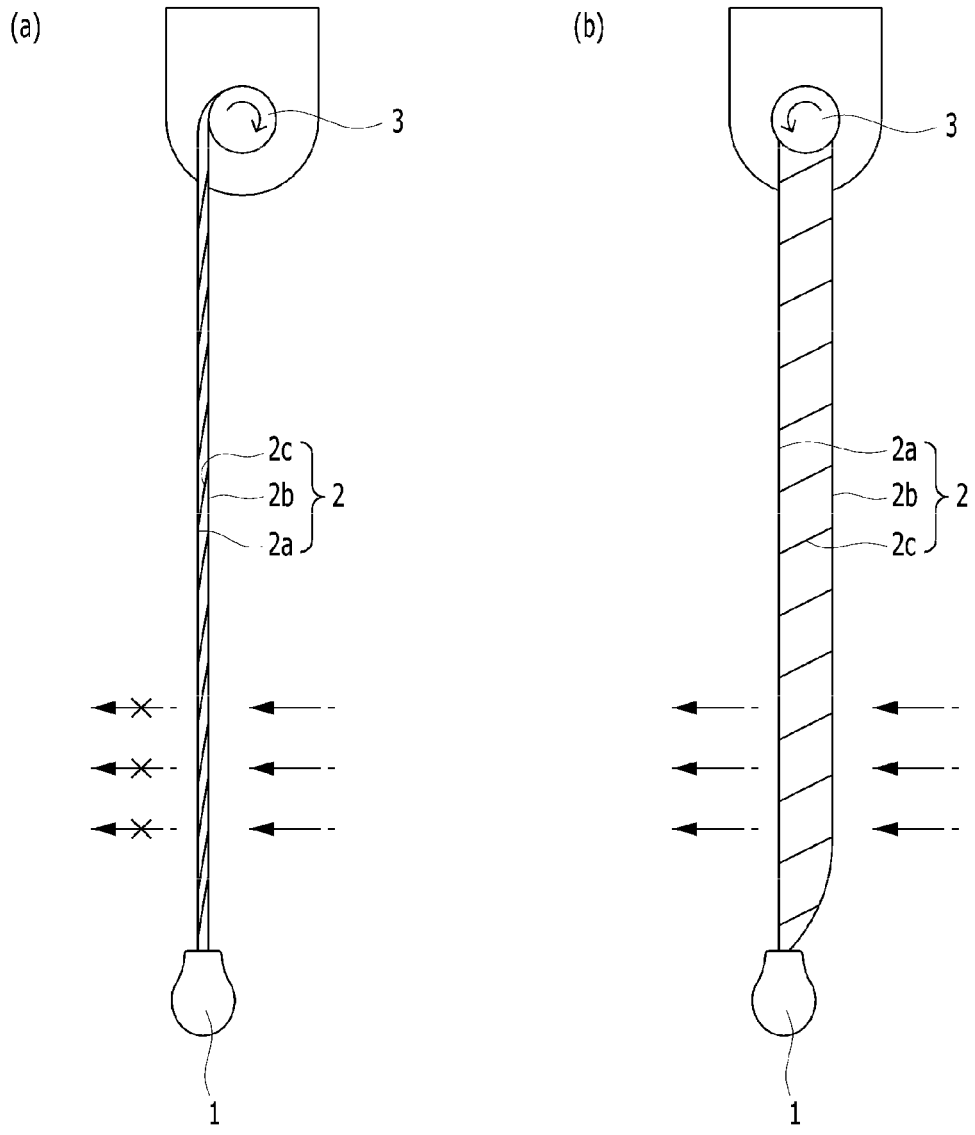
FIG. 8 is a view illustrating an operation for adjusting an amount of light by the blind apparatus.
Figure 9:
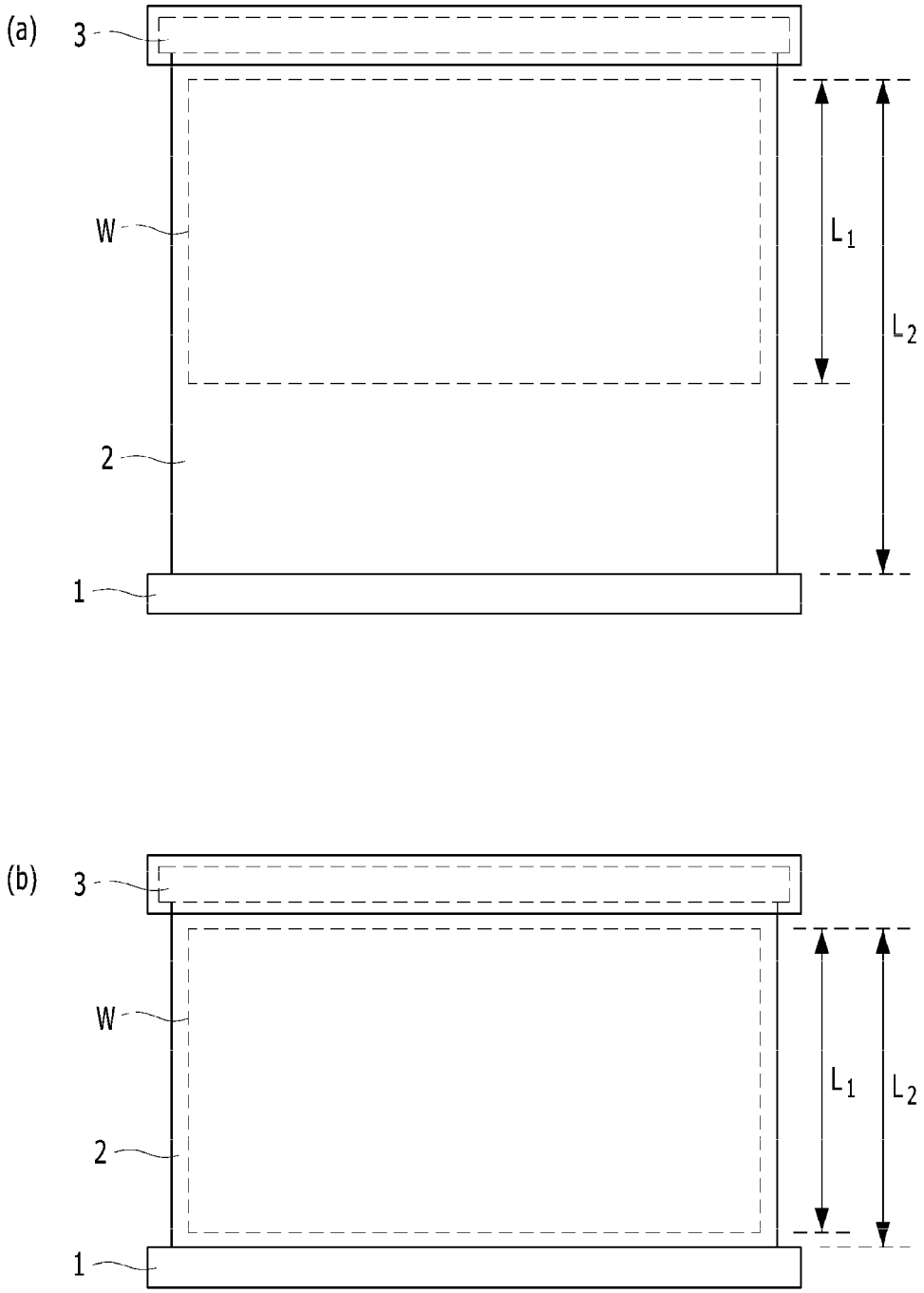
FIG. 9 is a view illustrating a change in length of a screen depending on the length of a window.

FIG. 5 is a view showing a change in length of a screen by rotation of the first bar, FIGS. 6 and 7 are view illustrating the operation of the under-structure, FIG. 8 is a view illustrating an operation for adjusting an amount of light by the blind apparatus, and FIG. 9 is a view illustrating a change in length of a screen depending on the length of a window.

Referring to FIG. 5, as the first bar 10 is rotated relative to the second bar 30, the entire length of the screen 2 when it is pulled down can be appropriately adjusted.

The lower end of the screen 2 is fixed to the first bar 10 and the first bar 10 is disposed in the second bar 30. The cover 40 is coupled to an end of the second bar 30, that is, the cover 40 may be coupled to the second bar 30 by the first fastening portion 41 and the second fastening portion 42.

When it is not required to adjust the entire length of the screen 2 that has been pulled down, as shown in (a) of FIG. 5, the first bar 10 is not rotated relative to the second bar 30. On the contrary, when it is required to adjust the entire length of the screen 2 that has been pulled down, as shown in (b) of FIG. 5, the first bar 10 is rotated relative to the second bar 30. As the first bar 10 is rotated, the lower end of the screen 2 is rolled around the first bar 10, so the entire length of the screen 2 that has been pulled down can be adjusted. It is possible to adjust step by step the length of the screen 2 that has been pulled down in accordance with the degree of rotation of the first bar 10. As described above, when the screen 2 is rolled around the first bar 10, additional tension is applied to the lower end of the screen 2, so deformation such as wrinkles or waves of the screen 2 can be removed by the additional tension. As the first bar 10 is rotated, the screen 2 can be brought in contact with the first fastening portion 41, so the additional tension can be easily maintained.

FIG. 6 is a view illustrating a process when torque from the wrench plug is transmitted to the plug and the first bar and FIG. 7 is a view illustrating a process when the torque from the wrench plug is stopped.

The plug 20 is coupled to the first end of the first bar 10 and the assistant plug 70 is coupled to the second end. The first bar 10 is disposed in the second bar 30, and the cover 40 is coupled to the first end of the second bar 30 and the assistant cover 80 is coupled to the second end. The rotary shaft 81 of the assistant cover 80 is rotatably inserted in the rotational hole 70*a* of the assistant plug 70 and supports the first bar 10, and the wrench bar 51 of the wrench plug 50 is fitted in the first through-hole 20*a* of the plug 20 through the second through-hole 40*a* of the cover 40.

When the first bar 10 is not rotated relative to the second bar 30, as shown in (a) of FIG. 6, the fixing protrusions 53 of the wrench plug 50 are inserted in the fixing holes 40*b* of the cover 40. As the fixing protrusions 53 are inserted in the fixing hole 40*b*, rotation of the wrench plug 50 is limited, so the plug 20 and the first bar 10 are prevented from rotating relative to the second bar 30. The wrench bar 51 can be maintained with the prismatic first section A in the first through-hole 20*a*.

On the contrary, in order to rotate the first bar 10 relative to the second bar 30, as shown in (b) of FIG. 6, the wrench plug 50 where the handle 60 is coupled is partially pulled out of the cover 40, thereby separating the fixing protrusions 53 of the wrench plug 50 out of the fixing holes 40*b* of the cover 40. Since the projections 52 are formed at the boundary between the first section A and the second section B, a user can pull out the wrench plug 50 within the first section A where the wrench plug 50 can be rotated. That is, the user can pull and turn the wrench plug 50 until the projections 52 reach the plug 20. As the fixing protrusions 53 are separated out of the fixing hole 40*b*, the wrench plug 50 can be rotated and torque from the wrench plug 50 is transmitted through the wrench bar 51, so the plug 20 and the first bar 10 can be rotated relative to the second bar 30. As the plug 20 and the first bar 10 are rotated, the lower end of the screen 2 can be rolled on or unrolled from the first bar 10.

On the other hand, as shown in (a) of FIG. 7, when the wrench plug 50 is further pulled out from the cover 40, the wrench bars 51 applying elasticity to the inner side of the first through-hole 20*a* close to the center, so the projections 52 can be inserted into the first through-hole 20*a* of the plug 20. That is, the cylindrical second section B of the wrench bar 51 can be partially inserted into the first through-hole 20*a*.

Thereafter, when the wrench plug 50 is further pulled, the outer side at the end of the wrench bar 51 is locked to the plug 20, in which the wrench bar 51 can be maintained with the second section B inserted in the first through-hole 20*a*. As the second section B is inserted into the first through-hole 20*a*, torque from the wrench plug 50 is not transmitted to the plug 20 and the first bar 10, so the plug 20 and the first bar 10 may idle with respect to the wrench plug 50, or the wrench plug 50 and the plug 20 may idle with respect to the first bar 10.

Referring to FIG. 8, the blind apparatus 100 adjusts the amount of light traveling through the screen 2 by changing the degree of overlapping of the first screen 2*a*, the second screen 2*b*, and the third screen 2*c*. For example, as shown in (a) of FIG. 8, when the third screens 2*c* are vertically arranged between the first screen 2*a* and the second screen 2*b* by rotating the roll 3, light can be blocked. The first screen 2*a* and the second screen 2*b* may operate as a single screen in contact with each other. In contrast, as shown in (b) of FIG. 8, when the third screens 2*c* are horizontally arranged between the first screen 2*a* and the second screen 2*b* by rotating the roll 3, light can be passed.

According to a blind apparatus of the related art that adjusts the amount of light traveling through the screen 2 by changing the arrangement of the third screens 2*c*, as shown in (a) of FIG. 9, it is possible to adjust the amount of light only when the screen 2 is fully pulled down. That is, when the vertical length L1 of a window W is smaller than the vertical length L2 of the screen 2 that has been fully pulled down, it is required to fully pull down the screen to adjust the amount of light.

However, according to the blind apparatus 100 of the present invention, since it is possible to simply roll/unroll the lower end of the screen 2 on/from the first bar 10, it is possible to adjust the vertical length L2 of the screen 2 that has been fully pulled down to fit to the vertical length L1 of the window W.

A wrench plug 50 according to another exemplary embodiment of the present invention will be described hereafter in detail with reference to FIG. 10.

Figure 10:
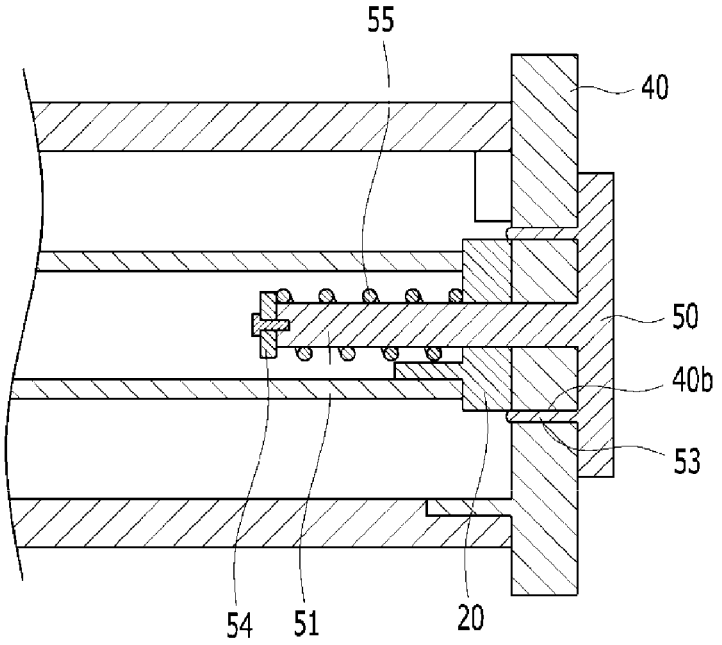
FIG. 10 is a view illustrating the operation of a wrench plug according to another embodiment of the present invention.
Figure 10:
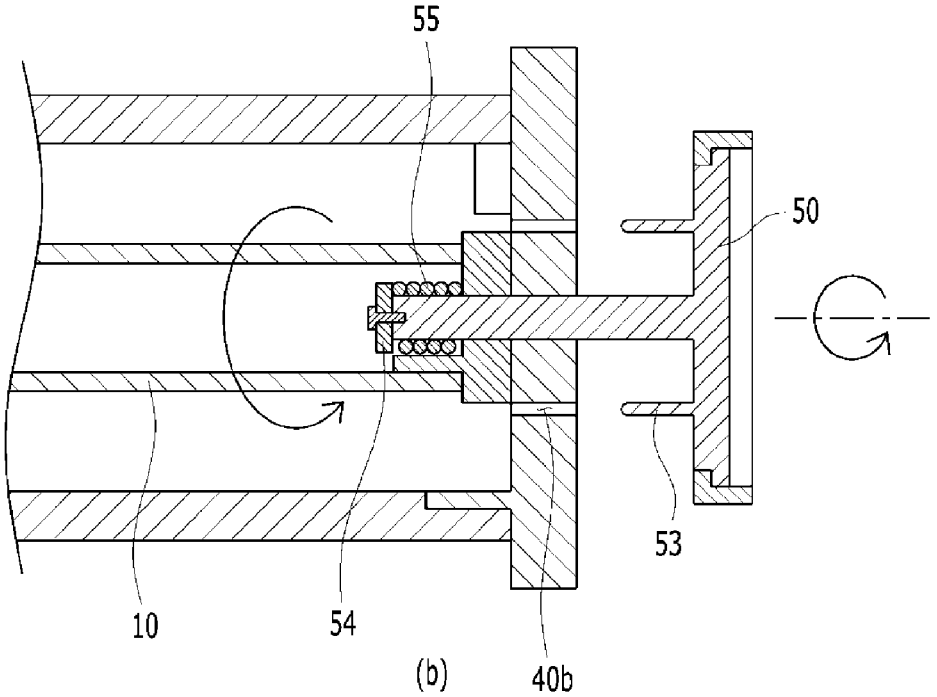

FIG. 10 is a view illustrating the operation of a wrench plug according to another embodiment of the present invention.

A wrench plug 50 according to another embodiment of the present invention further includes a flange part 54 and an elastic member 55. The wrench plug 50 according to another embodiment of the present invention is substantially the same as that in the previous embodiment except for further including the flange part 54 and the elastic member 55. Accordingly, the difference is described and the above description is substituted for other configuration not specifically stated.

The wrench plug 50 may further include the flange part 54 and the elastic member 55.

The flange part 54 is a plate extending outward at the end of the wrench bar 51. Although the flange part 54 is thread-fastened to the wrench bar 51 in the figure, the present invention is not limited thereto and it may be modified in various structures as long as it can be fixed to the wrench bar 51. For example, the flange part 54 may be bonded to the wrench bar 51 by an adhesive. The elastic member 55 is disposed between the flange part 54 and the plug 20.

The elastic member 55, which transmits elasticity to bring the wrench plug 50 in contact with the cover 40, for example, may be a compression spring. That is, the elastic member 55 is longitudinally compressed when force is applied, and returns to the initial position when the force is removed. The elastic member 55 brings the wrench plug 50 in contact with the cover 40 with one end in contact with the flange part 54 and the other end in contact with the plug 20.

For example, as shown in (a) of FIG. 10, when the wrench plug 50 is prevented from turning by inserting the fixing protrusions 53 of the wrench plug 50 in the fixing hole 40*b* of the cover 40, the elastic member 55 is maintained in the initial position. As the elastic member 55 is maintained in the initial position, the wrench plug 50 can be in contact with the cover 40. On the contrary, as shown in (b) of FIG. 10, when the fixing protrusions 53 are separated out of the fixing hole 40*b* and the wrench plug 50 is operated, the elastic member 55 is compressed. When the force for operating the wrench plug 50 is removed, the elastic member 55 returns and the wrench plug 50 can be brought in contact with the cover 40. The wrench plug 50 prevents the screen 2 from unexpectedly unrolled, when a user does not roll or unroll the screen 2.

According to the present invention, it is possible to simply adjust the entire length of a screen that has been pulled down to fit to the entire length of a window without assembling or disassembling the apparatus. Accordingly, when it is a double screen, it is possible to remove the trouble that it is required to fully unroll down a screen to adjust the amount of light and then roll back up the screen.

Further, it is possible to easily remove wrinkles or waves at the lower end or around the lower end of the screen, so the external appearance of the blind apparatus can be improved, and functional deterioration of the blind apparatus due to wrinkles or waves can be prevented.

Although exemplary embodiments of the present invention were described above with reference to the accompanying drawings, those skilled in the art would understand that the present invention may be implemented in various ways without changing the necessary features or the spirit of the prevent invention. Therefore, it should be understood that the exemplary embodiments are not limiting but illustrative in all aspects.

What is claimed is:

1. An under-structure of a blind apparatus, comprising:

a first bar configured to hold a lower end of at least one screen;

a plug configured to be coupled to an end of the first bar, the plug having a first through-hole at a center;

a second bar configured to receive the first bar, the second bar having a slit through which the at least one screen is adapted to come out;

a cover configured to be fixed to an end of the second bar, the cover having a second through-hole in communication with the first through-hole; and a wrench plug coupled to the outside of the cover, the wrench plug having a wrench bar fitted in the first through-hole through the second through-hole to transmit torque, wherein at least one fixing hole is formed at one of the wrench plug and the cover and at least one fixing protrusion is formed at the other of the wrench plug and the cover, and the at least one fixing protrusion is configured to be inserted into the at least one fixing hole at a contact surface of the wrench plug and the cover.

2. The under-structure of claim 1, wherein the wrench bar has a non-circular cross-sectional portion in a section, and the first through-hole has a non-circular cross-sectional shape corresponding to the non-circular cross-sectional portion of the wrench bar.

3. The under-structure of claim 2, wherein the wrench bar has a prismatic first section and a cylindrical second section extending from the prismatic first section.

4. The under-structure of claim 3, wherein the wrench bar has at least one projection protruding outward at a boundary between the prismatic first section and the cylindrical second section, a protruding direction of the at least one projection being perpendicular to a longitudinal direction of the wrench bar.

5. The under-structure of claim 1, wherein the wrench bar includes a plurality of parts divided in a longitudinal direction of the wrench bar, and is configured to apply elasticity to an inner side of the first through-hole by the plurality of parts.

6. The under-structure of claim 5, wherein an outer diameter at an end of the wrench bar is larger than an inner diameter of the first through-hole.

7. The under-structure of claim 1, wherein the wrench plug includes a flange part, the flange part being a plate extending outward at an end of the wrench bar, and an elastic member, the elastic member between the flange part and the plug in a longitudinal direction of the wrench bar and transmitting elasticity for the wrench plug to be in contact with the cover.

8. The under-structure of claim 1, further comprising, a handle coupled to the wrench plug, the handle including a grip, the grip having a larger diameter or a larger thickness than the wrench plug.

9. A blind apparatus comprising:

at least one screen;

a roll fixed to an upper end of the at least one screen, the roll configured to roll up the screen; and the under-structure of the blind apparatus of claim 1.

10. The blind apparatus of claim 9, wherein the at least one screen includes:

a first screen and a second screen attached to different positions on an outer side of the roll, a first screen and a second screen overlapping each other; and a plurality of third screens connecting the first screen and the second screen to each other, the plurality of third screens arranged in parallel with regular intervals.

* * * * *